US006029614A

United States Patent [19]

Kayahara et al.

[11] Patent Number: 6,029,614

[45] Date of Patent: Feb. 29, 2000

[54] WATER-TUBE BOILER WITH RE-CIRCULATION MEANS

[75] Inventors: Toshihiro Kayahara; Noboru Takubo; Kanta Kondou, all of Matsuyama, Japan

[73] Assignees: Miura Co., Ltd.; Miura Institute of Research & Development Co., Ltd., both of Ehime-ken, Japan

[21] Appl. No.: 09/002,027

[22] Filed: Dec. 31, 1997

[30] Foreign Application Priority Data

Oct. 31, 1997 [JP] Japan ..... 9-316156

[51] Int. Cl.[7] ..... F22B 23/04

[52] U.S. Cl. ..... 122/367.1; 122/17

[58] Field of Search ..... 122/17, 78, 367.1–367.2, 122/367.3; 110/234

[56] References Cited

U.S. PATENT DOCUMENTS 2,993,479 7/1961 Thurley .
4,022,163 5/1977 Baumgartner et al. ..... 122/225 R
4,453,496 6/1984 Yoshinari .
4,825,813 5/1989 Yoshinari et al. ..... 122/367.1
5,020,479 6/1991 Suesada et al. .
5,199,384 4/1993 Kayahara et al. .
5,273,001 12/1993 Kayahara et al. .
5,353,748 10/1994 Kayahara et al. .
5,433,174 7/1995 Brady et al. ..... 122/367.1

FOREIGN PATENT DOCUMENTS 60-078247 5/1985 Japan .

*Primary Examiner*—Tu Ba Hoang
*Assistant Examiner*—Gregory A. Wilson

[57] ABSTRACT

The water-tube boiler fulfills the reduction in $NO_x$ with a simple constitution, and achieves reduction in $NO_x$ and reduction in CO at the same time with a simple constitution. In the water-tube boiler, a plurality of water tubes (5) are arranged in a zone where burning-reaction ongoing gas derived from a burner (10) is present within a combustion chamber (9), and exhaust gas recirculation equipment (26) is provided to feed part of exhaust gas exhausted from the combustion chamber 9 to the burner 10.

13 Claims, 6 Drawing Sheets

WATER-TUBE BOILER WITH RE-CIRCULATION MEANS

BACKGROUND OF THE INVENTION

The present invention relates to water-tube boilers such as once-through boilers, natural circulation water-tube boilers and forced circulation water-tube boilers.

The water-tube boiler includes body of which is made up by water tubes. The body arrangement of such a water-tube boiler includes, for example, a plurality of water tubes arranged into an annular shape. In this type of water-tube boiler, a cylindrical space surrounded by the annular water tube array is used as a combustion chamber. In such a water-tube boiler, heat transfer is performed primarily by radiation within the combustion chamber, and heat transfer (primarily by convection) is performed downstream from the combustion chamber. In recent years, such water-tube boilers are also desirable to reduce $NO_x$ and CO emissions.

SUMMARY OF THE INVENTION

An object of the present invention is to reduce $NO_x$ emissions using a simple construction for a water-tube boiler, and to reduce both $NO_x$ and CO emissions at the same time with a simple construction.

As a first aspect of the present invention, a water-tube boiler includes a plurality of water tubes are arranged in a zone where burning-reaction ongoing gas from a burner is present within a combustion chamber. The water-tube boiler includes exhaust gas re-circulation equipment for feeding part of exhaust gas exhausted from the combustion chamber back to the burner. As a second aspect of present invention, the water-tube boiler includes water tubes arranged into an annular shape in the zone where the burning-reaction ongoing gas is present.

As a third aspect of the present invention, a water-tube boiler is provided which includes: a first water tube array formed by arranging a plurality of water tubes in a zone where burning-reaction ongoing gas from the burner is present within a combustion chamber. Gaps are provided between adjacent water tubes of the first water tube array so as to permit the burning-reaction ongoing gas to flow therethrough. A zone is provided around the first water tube array to allow burning reaction to continuously take place gas recirculation equipment for feeding part of exhaust gas exhausted from the combustion chamber to the burner.

The present invention particulary multiple-tube type water-tube boiler. Further, the water-tube boiler of the present invention applies not only to steam boilers or hot water boilers, but also as heat medium boilers in which a heat medium is heated.

Referring first to the present invention designed to reduce in $NO_x$ emissions, the water-tube boiler as described in the first aspect of the invention is a water-tube boiler in which a plurality of water tubes are arranged in a zone where burning-reaction ongoing gas derived from the burner within a combustion chamber (hereinafter, referred to as "burning reaction zone"), the water-tube boiler comprising exhaust gas re-circulation equipment for feeding part of exhaust gas exhausted from the combustion chamber to the burner. The combustion chamber is so formed that part or entirety of its interior serves as a space for burning reaction, where the space is defined by water tube arrays in one case or by exterior walls formed of refractory materials in another case. The burning-reaction ongoing gas refers to a high-temperature gas during the process that burning reaction is taking place in the combustion chamber. The burning reaction zone is preferably a zone where a flame is taking place in the burning-reaction ongoing gas, or a zone where a high-temperature burning-reaction ongoing gas is present with the temperature of the burning-reaction ongoing gas above 900° C. The flame herein referred to is a phenomenon that occurs to burning-reaction ongoing gas that is in the course of a vigorous burning reaction. This flame may be visually discerned in some cases or may be different to visually discern or impossible to visually discern in other cases.

Therefore, in the water-tube boiler according to the first aspect of the invention, by arranging a plurality of water tubes in the burning reaction zone, the burning-reaction ongoing gas is cooled by the plurality of water tubes so that the temperature is lowered, by which the generation of thermal $NO_x$ is suppressed. The reason of this is that, as explained in the Zeldovich mechanism, the more the temperature of burning reaction is high, the more the thermal $NO_x$ is accelerated in its generation rate with its generation amount increasing; that is, the more the temperature of burning reaction is low, the more the thermal $NO_x$ is decelerated in its generation rate with its generation amount decreasing. Especially when the temperature of burning reaction is under 1400° C., the generation rate of the thermal $NO_x$ is remarkably retarded.

Also in the first aspect of the invention, the water-tube boiler is provided with exhaust gas re-circulation equipment so that even further reduction in $NO_x$ can be realized. That is, oxygen concentration is reduced by mixing part of the exhaust gas exhausted from the combustion chamber into the combustion air fed to the burner, and the generation amount of $NO_x$ is reduced by suppressing any increase in the temperature of the burning-reaction ongoing gas.

In the second aspect of the invention, there is provided a water-tube boiler in which the water tubes are arranged into an annular shape in the zone where the burning-reaction ongoing gas is present. In this arrangement, a plurality of water tubes are arranged into an annular shape, because the burning-reaction ongoing gas performs heat transfer upon contact with the individual water tubes, thermal load can be generally uniformed. Further, because the burning-reaction ongoing gas is cooled by the individual water tubes, the effect of reducing $NO_x$ is also conducted generally uniformly on the entire circumference of the annular water tube array.

The above annular arrangement of a plurality of water tubes may be not only a completely circular arrangement of a plurality of water tubes but also an elliptical arrangement. Otherwise, the plurality of water tubes may be arranged into triangular, quadrangular or higher polygonal shapes. Furthermore, for the arrangement of the plurality of water tubes into an annular shape, the water tubes may be arranged in such a way that the lines connecting center to center of the water tubes form projections and recesses.

In the third aspect of the invention, gaps which permit the burning-reaction ongoing gas to flow therethrough are formed between adjacent water tubes. Each of these gaps has such a width that the burning-reaction ongoing gas passing through these gaps will keep burning reaction even if cooled by the water tubes, where the width needs to be at least 1 mm.

In the third aspect of the invention, heat-recovery water tubes are arranged outside the water tubes arranged into an annular shape. These heat-recovery water tubes perform further heat recovery from the burning-reaction ongoing gas that has passed through the gaps between the water tubes as well as a gas that has completed the burning reaction (hereinafter, referred to as "burning-reaction completed gas"), so that the efficiency of the water-tube boiler is enhanced.

Referring next to the invention for designing the simultaneous implementation of $NO_x$ reduction and CO reduction, as a third aspect of the invention, there is provided a water-tube boiler which comprises: a first water tube array formed by arranging a plurality of water tubes in a zone where burning-reaction ongoing gas derived from the burner is present within a combustion chamber (hereinafter, referred to as "burning reaction zone"); gaps provided between adjacent water tubes of the first water tube array so as to permit the burning-reaction ongoing gas to flow therethrough; a zone provided around the first water tube array to allow burning reaction to be continuously effected (hereinafter, referred to as "burning-reaction continuing zone"); and exhaust gas re-circulation equipment for feeding part of exhaust gas exhausted from the combustion chamber to the burner. The combustion chamber, the burning-reaction ongoing gas and the burning reaction zone herein referred to are of the same meanings as in the description of the first aspect, and the case is the same also with the flame.

In the third aspect of the invention, by arranging a plurality of water tubes in the burning reaction zone, the burning-reaction ongoing gas is cooled by the plurality of water tubes so that the temperature is lowered, by which the generation of thermal $NO_x$ is suppressed. During this process, the burning-reaction ongoing gas flows through the gaps between the water tubes, so that the $NO_x$ reduction effect due to the cooling is enhanced. The reason of this is as explained in the Zeldovich mechanism, as has been described for the first aspect.

This burning-reaction continuing zone is a zone where, after the burning reaction inside the first water tube array, intermediate products of burning reaction such as CO and HC as well as unburnt components of the fuel are subjected to burning reaction. The burning-reaction ongoing gas will flow into this burning-reaction continuing zone through the gaps. Because CO remaining in the burning-reaction ongoing gas will be oxidized into $O_2$ during the flow in the burning-reaction continuing zone, the discharge amount of CO from the water-tube boiler is lessened.

According to the third aspect of the invention, in which a plurality of water tubes are arranged into an annular shape, because the burning-reaction ongoing gas performs heat transfer upon contact with the individual water tubes, thermal load can be generally uniformed. Further, because the burning-reaction ongoing gas is cooled by the individual water tubes, the effect of reducing $NO_x$ is also conducted generally uniformly on the entire circumference of the first water tube array. In this case, the annular arrangement of the plurality of water tubes may be circular, elliptical, polygonal shapes, as described for the first aspect, moreover the arrangement may be such that the lines connecting center to center of the water tubes form projections and recesses.

In the third aspect of the invention, in which gaps are provided between adjacent water tubes so as to permit the burning-reaction ongoing gas to flow therethrough, each of these gaps has such a width that the burning-reaction ongoing gas passing through these gaps will keep burning reaction even if cooled by the water tubes, where the width needs to be at least 1 mm. Then, the gaps do not need to be formed every adjacent water tubes; instead, for example, the plurality of water tubes may be arranged so that a specified number of water tubes are gathered in close contact, and that gaps are provided between one group of such closely gathered water tubes and another. Further, the gaps do not need to be all of the same width, but the plurality of water tubes may be arranged into an annular shape so that wider gaps and narrower gaps are provided.

Also, a plurality of heat-recovery water tubes are arranged outside the first water tube array, and these heat-recovery water tubes are arranged into an annular shape to form a second water tube array. Within the burning-reaction continuing zone located outside the first water tube array, the burning-reaction ongoing gas has generated heat due to the continued reaction, including the oxidation reaction of CO as well as the reaction of intermediate products of the burning reaction and unburnt components of the fuel. Therefore, heat recovery from the burning-reaction ongoing gas and the burning-reaction completed gas including the aforementioned heat is performed by the heat-recovery water tubes. As a result, effective use of heat can be made by the heat-recovery water tubes, so that the thermal efficiency is enhanced. By arranging the second water tube array into an annular shape, the heat-recovery water tubes will make generally uniform contact with the burning-reaction ongoing gas as well as the burning-reaction completed gas, so that heat transfer from those gases can be conducted generally uniformly.

In the aforementioned water-tube boiler, the plurality of water tubes are arranged within the combustion chamber so that temperature of the burning-reaction ongoing gas after making contact with the water tubes will be below 1400° C. With this arrangement, the temperature of the burning-reaction ongoing gas lowers so that the generation of thermal $NO_x$ is lessened and therefore that the reduction in $NO_x$ for the water-tube boiler can be achieved.

According to the invention of the third aspect, as in the first aspect of the invention, the water-tube boiler comprises exhaust gas re-circulation equipment, so that part of the exhaust gas exhausted from the combustion chamber is mixed into the combustion air fed to the burner, by which the oxygen concentration is reduced while increase in the flame temperature is suppressed. Thus, even further reduction in $NO_x$ can be realized.

DETAILED DESCRIPTION OF THE PREFERRED EMBODIMENTS

Figure 1:
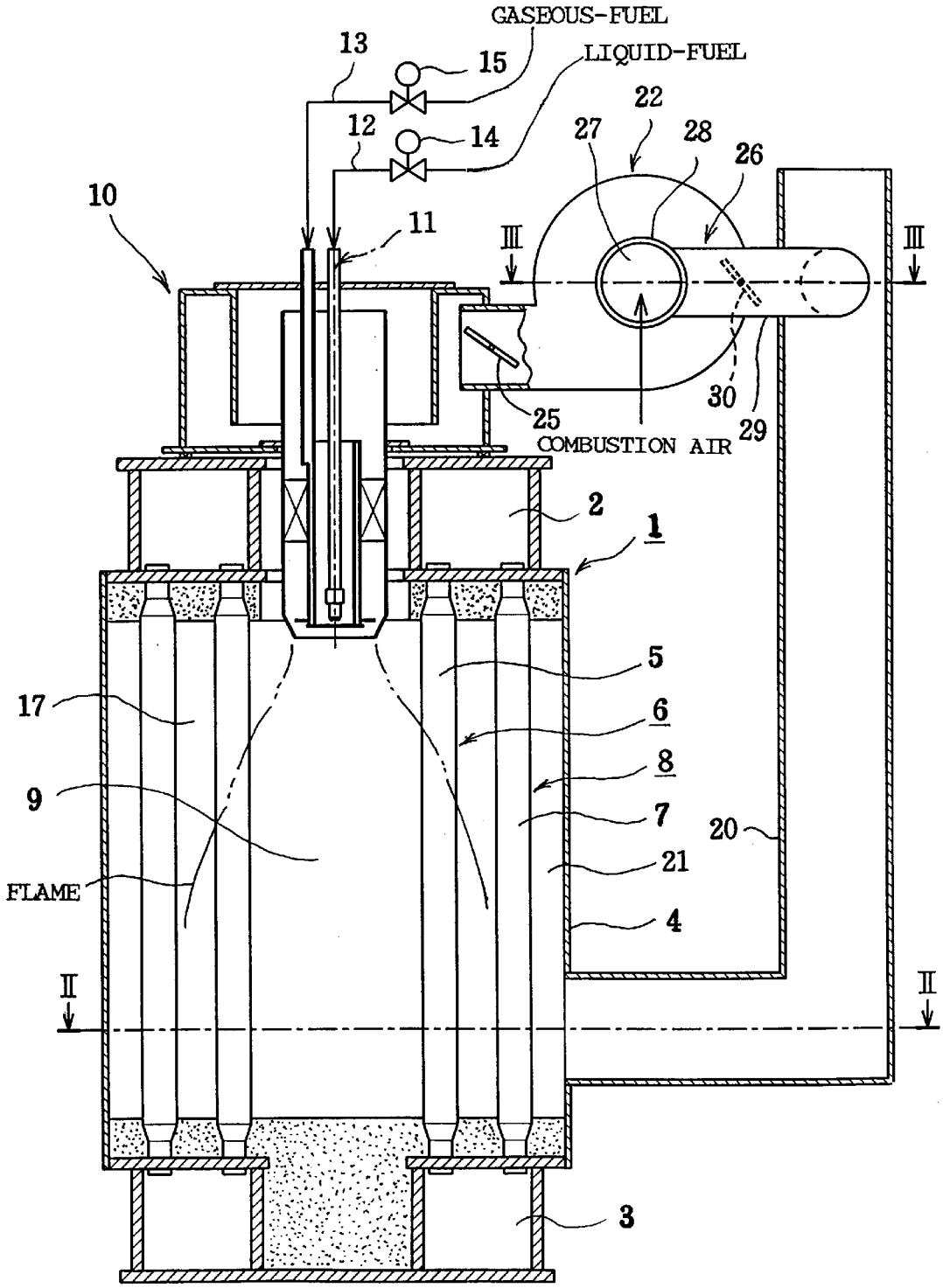
FIG. 1 is an explanatory view of a vertical cross section of a first embodiment of the present invention.
Figure 2:
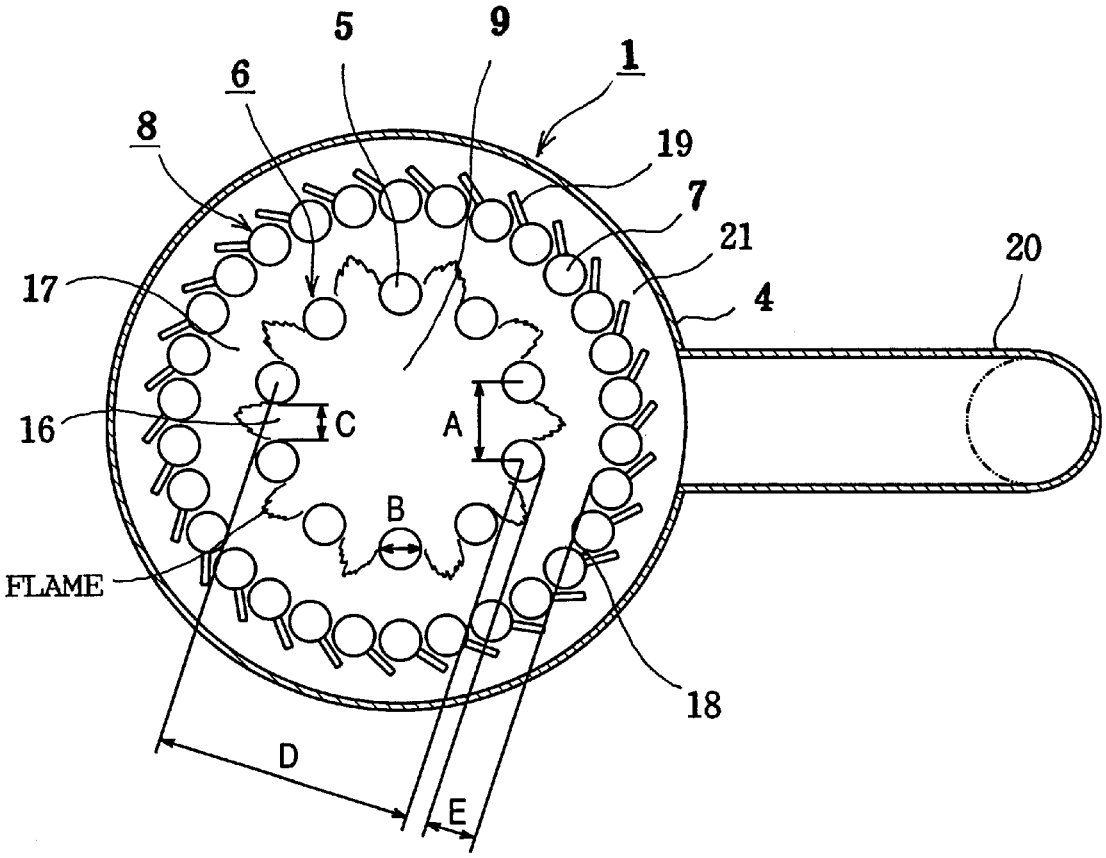
FIG. 2 is an explanatory view of a cross section taken along the line II—II of FIG. 1.
Figure 3:
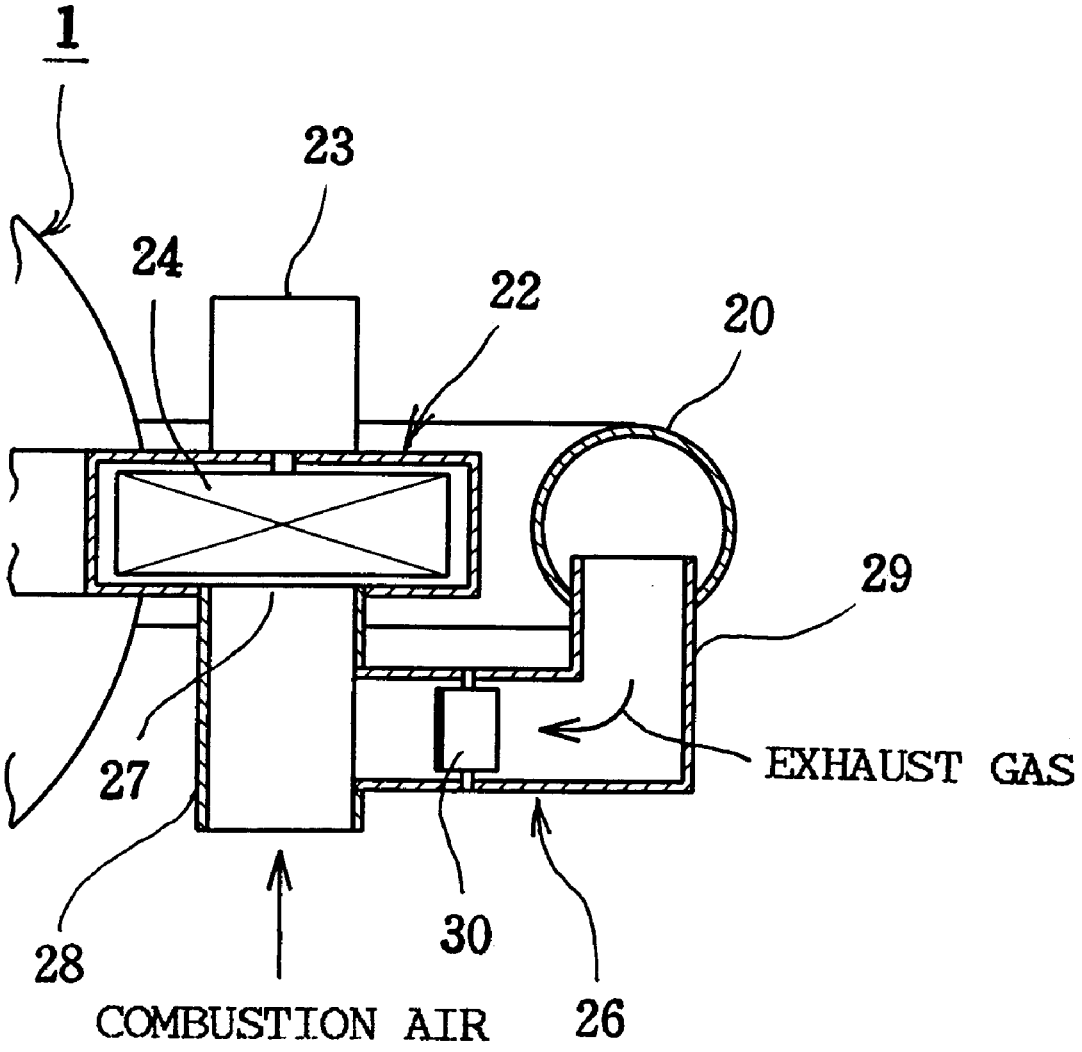
FIG. 3 is an explanatory view of a cross section taken along the line III—III of FIG. 1.

Hereinbelow, a first embodiment of the present invention is a multiple-tube type once-through boiler and is described with reference to FIGS. 1, 2 and 3. FIG. 1 is a vertical cross section of the first embodiment of the invention. FIG. 2 is a cross section taken along the line II—II of FIG. 1, and FIG. 3 is a cross section taken along the line III—III of FIG. 1.

A boiler body 1 has an upper header 2 and a lower header 3 spaced away from each other by a specified distance. An outer wall 4 extends between outer circumferences of the upper header 2 and lower header 3, respectively.

Between the upper header 2 and the lower header 3, a plurality (ten in the first embodiment) of water tubes 5 are arranged in an annular shape. These water tubes 5 together constitute an annular first water tube array 6. Also, between the upper header 2 and the lower header 3, and near the inner circumference of the outer wall 4, a plurality (thirty in the first embodiment) of heat-recovery water tubes 7 are arrayed into an annular shape to form an annular second water tube array 8. This second water tube array 8, in combination with the first water tube array 6, constitutes a double annular water tube array. The water tubes 5 and the heat-recovery water tubes 7 are connected at their ends to the upper header 2 and the lower header 3, respectively.

A combustion chamber 9 of the boiler is defined by the upper header 2, the lower header 3 and the second water tube array 8. On top of the combustion chamber 9 is fitted a burner 10. This burner 10 is inserted on an interior side (center) of the upper header 2 toward the combustion chamber 9, so that an axis 11 of the burner 10 is generally parallel to the water tubes 5 of the first water tube array 6. This burner 10 uses to either liquid fuel or gaseous fuel. To a liquid-fuel feed line 12 and a gaseous-fuel feed line 13 are connected to burner 10. To switch between the fuels, a liquid-fuel valve 14 on the liquid-fuel feed line 12 and a gaseous-fuel valve 15 on the gaseous-fuel feed line 13 are provided.

The burner 10 causes a zone where burning-reaction ongoing gas is present, (i.e. a burning reaction zone), in the combustion chamber 9, whereas the first water tube array 6 is located in a zone outside of the burning reaction zone where a flame is present (hereinafter, referred to as "flame-present zone"). The first water tube array 6 is disposed in the burning reaction zone so that the temperature of the burning-reaction ongoing gas, after contacting the water tubes 5, will be below 1400° C. Further, in the first water tube array 6, gaps 16 allowing the flow of burning-reaction ongoing gas are formed between water tubes 5.

A zone 17 where burning reactions of intermediate products such as CO and HC and unburnt components of the fuel continues (hereinafter, referred to as "burning-reaction continuing zone") is provided between the first water tube array 6 and the second water tube array 8. Within this burning-reaction continuing zone 17, no heat-absorbing members such as the water tubes 5 are present.

In the second water tube array 8, gaps 18 between adjacent heat-recovery water tubes 7 (hereinafter, referred to as "second gaps") are narrow, normally between 1 to 4 mm. Further, on the outer circumferential side of the second water tube array 8, the heat-recovery water tubes 7 are each provided with a heat-transfer fin 19.

Further, the outer wall 4 is provided with a smokestack 20. This smokestack 20 communicates with an annular exhaust gas flow path 21 formed between the outer wall 4 and the second water tube array 8.

An air blower 22 is connected to the burner 10. This air blower 22 comprises a drive motor 23, an impeller 24 and a damper 25. This damper 25 allows the amount of combustion air for the burner 10 to be adjusted. The air blower 22 and the smokestack 20 are connected to each other by exhaust gas re-circulation equipment 26 that re-circulates part of the exhaust gas. That is, an inlet pipe 28 is connected to an inlet 27 of the air blower 22, and an intermediate point of the inlet pipe 28 and an intermediate point of the smokestack 20 are connected to each other by an exhaust gas pipe 29, so that part of the exhaust gas is fed to the burner 10 via the air blower 22. An exhaust gas damper 30 is provided within the exhaust gas pipe 29, allowing the amount of re-circulation of exhaust gas to be adjusted. Exhaust gas damper 30 and exhaust gas pipe 29 constitute the exhaust gas re-circulation equipment 26.

In the once-through boiler of the above constitution, when the burner 10 is activated, burning-reaction ongoing gas is formed within the combustion chamber 9. In the initial stages of the burning reaction of this burning-reaction ongoing gas, fuel decomposition occurs and then the decomposed fuel reacts with oxygen vigorously. Thereafter intermediate products such as CO and HC that have been generated in the burning reaction above react further. Thus, burning-reaction completed gas, which has completed burning reaction, is exhausted from the boiler body 1 as exhaust gas. In the region where the burning reaction is vigorously effected, a flame normally forms.

The burning-reaction ongoing gas flows through central part of the first water tube array 6 nearly along its axis, as the gas expands toward the lower header 3, thus flowing into the burning-reaction continuing zone 17 through the gaps 16. Accordingly, as shown in FIG. 1, the flame formed beyond (i.e., outside of) the first water tube array 6 as the burning-reaction ongoing gas flows along. This means that the water tubes 5 are located inside the flame-present zone within the burning reaction zone. Then, the burning-reaction ongoing gas that causes the flame, when passing through the gaps 16, exchanges heat with heated fluid in the water tubes 5. The burning-reaction ongoing gas that causes the flame is rapidly cooled by this heat exchange by which the generation of thermal $NO_x$ is suppressed. In this case, because the first water tube array 6 is an annular water tube array, the burning-reaction ongoing gas that causes the flame contacts the individual water tubes 5 uniformly, so that the thermal load on the water tubes 5 is generally uniform. Further, because this burning-reaction ongoing gas is cooled by generally uniform contact with the water tubes 5, the reduction in $NO_x$ due to the individual water tubes 5 becomes generally uniform. Besides, as a result of this, the flame formation is lessened in this burning-reaction ongoing gas.

Then, the burning-reaction ongoing gas that has passed through the gaps 16 is flowed in the burning-reaction continuing zone 17 toward the second water tube array 8. Until the burning-reaction ongoing gas reaches the second water tube array 8, the burning-reaction ongoing gas will not make contact with any members that perform like the water tubes 5, so that the temperature of the burning-reaction ongoing gas decreases little. Therefore, the burning-reaction ongoing gas flows through the burning-reaction continuing zone 17 while the burning reaction continues, and while an oxidation reaction from CO to $CO_2$ is accelerated. In this burning-reaction continuing zone 17, besides the aforementioned oxidation reaction, oxidation reactions of the intermediate products, unburnt components of the fuel and the like also occur.

The burning-reaction ongoing gas, now a high-temperature gas that has completed the burning reaction before it reaches the second water tube array 8, passes through the second gaps 18, flowing into the exhaust gas flow path 21. When the burning-reaction ongoing gas passes through the second gaps 18, more heat is transferred to the heated fluid within the heat-recovery water tubes 7 by the heat-transfer fins 19. The burning-reaction completed gas passed through the second gaps 18 and flowed into the exhaust gas flow path 21, after performing heat transfer from the outside of the second water tube array 8 to the heated fluid within the heat-recovery water tubes 7, is discharged as exhaust gas through the smokestack 20, out of the boiler. In this case, because the second water tube array 8 is an annular water tube array comprised of a plurality of heat-recovery water tubes 7, burning-reaction ongoing gas and the burning-reaction completed gas generally contact the individual heat-recovery water tubes 7 uniformly, so that heat recovery from burning-reaction ongoing gas and the burning-reaction completed gas is effected by the entire second water tube array 8. Thus, the thermal load on the heat-recovery water tubes 7 is generally uniform also in the second water tube array 8.

Part of the exhaust gas exhausted out of the boiler from the smokestack 20 is fed to the air blower 22 through the exhaust pipe 29. In the air blower 22, combustion air is sucked into the inlet 27 through the inlet pipe 28, where exhaust gas is also sucked in simultaneously, so that a mixture of the combustion air and the exhaust gas is fed to the burner 10.

In the above description, the flow of burning-reaction ongoing gas is directed along the radius of the first water tube array 6. Next, the description is focused on the flow of the burning-reaction ongoing gas along the axis of the first water tube array 6. Since the burning-reaction ongoing gas flows through central part of the first water tube array 6 generally along its axis while expanding toward the lower header 3 as described above, the temperature of the burning-reaction ongoing gas decreases due to the heat transfer to the water tubes 5 to a heater further downstream. Therefore, the generation of thermal $NO_x$ is suppressed. Also, because the first embodiment is a once-through boiler, heated fluid flows from the lower header 3 to the water tubes 5 and the heat-recovery water tubes 7, ascends in the water tubes 5 and the heat-recovery water tubes 7, while being heated, and is output from the upper header 2 as steam.

The once-through boiler of this first embodiment is explained in more detail. The first embodiment is a once-through boiler with an evaporation of 500 to 4000 kg per hour. In the once-through boiler of the first embodiment, the outside diameter B of the water tubes 5 is about 60 mm. While once-through boilers normally employ water tubes 5 having an outside diameter B of about 25 to 80 mm, water-tube boilers on the whole generally employ water tubes 5 having an outside diameter B of about 20 to 100 mm. Further in this first embodiment, the diameter D of the pitch circle of water tubes 5 as described before is about 344 mm. This diameter D needs to be at least 100 mm. A smaller diameter D results in a smaller space on the inner circumferential side of the first water tube array 6, making it difficult to maintain a stable burning reaction. On the other hand, a larger diameter D would result in a larger space on the inner circumferential side of the first water tube array 6, making it more likely that high-temperature regions which accelerate the generation of thermal $NO_x$ occur inside the space. Therefore, the upper limit of the diameter D is determined in accordance with the foregoing. Further, the upper limit of the diameter D is depends on the required amount of evaporation of the boiler. For example, for a water-tube boiler with an evaporation of 4000 kg/hr, the upper limit of its diameter D is 1000 mm.

Also in this first embodiment, the center-to-center distance A of adjacent water tubes 5 in the first water tube array 6 is about 106 mm, and the ratio of this center-to-center distance A to the outside diameter B of the water tubes 5, A/B, is 1.8. Then, where the gaps 16 are provided between the water tubes 5 as in this first embodiment, the width C of the gaps 16 is such that the burning reaction is not halted by the cooling of burning-reaction ongoing gas by the water tubes 5. The width C of the gaps 16 in this case needs to be at least 1 mm. Accordingly, for the gaps 16 to be provided between adjacent water tubes 5, the aforementioned ratio A/B is so set that $1<A/B\leqq 2$. This ratio A/B may be changed depending on the degree to which a reduction in $NO_x$ emission is required. In terms of this, the width C of the gaps 16 in the first embodiment is equal to the difference between the center-to-center distance A and the outside diameter B, about 46 mm.

Also in this first embodiment, the exhaust gas re-circulation ratio by the exhaust gas re-circulation equipment 26 is set to about 15%. The adjustment of this exhaust gas re-circulation ratio is carried out by adjusting the exhaust gas damper 30. The burner 10 in this first embodiment is set to an air ratio of 1.3, in which case the highest temperature of the burning-reaction ongoing gas is about 1500° C. due to the action of the exhaust gas re-circulation (about 1700° C. without exhaust gas re-circulation). In this connection, in the case of burners for water-tube boilers, the air ratio is set between 1.1 and 1.3 for burning. In this case, the highest temperature of the burning-reaction ongoing gas is 1700° C. with the air ratio of 1.1 to 1.2 (1800° C. without exhaust gas re-circulation), and 1600° C. with the air ratio of 1.2 to 1.3 (1700° C. without exhaust gas re-circulation).

By setting the center-to-center distance A and the outside diameter B of the water tubes 5 as stated above, the temperature of the burning-reaction ongoing gas at a time point of passing through the gaps 16 lowers to about 1000° C. due to the cooling by the individual water tubes 5. This temperature is below the temperature (about 1400° C.) at which the generation of thermal $NO_x$ is substantially reduced (about). This makes it possible to provide a once-through boiler with low $NO_x$ emissions. In this connection, the $NO_x$ emissions of the once-through boiler of the first embodiment is 25 ppm in 0% $O_2$ conversion (30 ppm without exhaust gas re-circulation). The temperature in this case is above the temperature at which the oxidation reaction from CO to $CO_2$ is vigorously effected (about 800° C.). As a result, the oxidation reaction from CO to $CO_2$ is vigorously effected while the burning-reaction ongoing gas is flowing within the burning-reaction continuing zone 17 so that a once-through boiler having a low CO discharge level can be provided.

As seen above, in the once-through boiler of the first embodiment, the temperature of burning-reaction ongoing gas flowing out from the gaps 16 of the first water tube array 6 is controlled to about 1000° C. However, it should generally be controlled to within a range of 800 to 1400° C. depending on the degree to which $NO_x$ reduction and CO reduction are required. In this connection, the temperature of burning-reaction ongoing gas flowing out from the gaps 16 is preferably as low as possible for $NO_x$ reduction, while it is preferably as high as possible for CO reduction. From this point of view, the temperature is preferably set within a range of 900 to 1300° C.

Further, in the first embodiment, the radial distance E between the first water tube array 6 and the second water tube array 8 is set as the width of the burning-reaction continuing zone 17. The distance E is about 84 mm, 1.4 times larger than the outside diameter B. By setting the distance E in this way, the residence time of burning-reaction ongoing gas within the burning-reaction continuing zone 17 is about 47 milliseconds. In this case, the discharge amount of CO is about 15 ppm. That is, in order to ensure the occurrence of aforementioned oxidation reaction, the burning-reaction ongoing gas needs to be kept above a about 800° C., while more than a certain reaction time is necessary at the same time. The reaction time decreases becomes shorter with increasing temperature of the burning-reaction ongoing gas increases, while the reaction time required becomes longer as the temperature of the burning-reaction ongoing gas decreases. Therefore, the set value of the distance E is changed depending on the temperature of the burning-reaction ongoing gas that flows out from the gaps 16, by which the residence time of the burning-reaction ongoing gas in the burning-reaction continuing zone 17 is adjusted. Besides, the distance E depends on the number and width C of the gaps 16. The lower limit for this residence time is between 1 and 10 milliseconds. As a result, the lower limit of the distance E is about 0.5 times as large as the outside diameter B. Also, although a somewhat longer set value of the residence time is advantageous in terms of the CO reduction, the residence time is determined depending on the degree to which the CO reduction and the boiler downsizing are demanded. In this case, the upper limit of the distance E is preferably six times as large as the outside diameter B.

The burner 10 is not limited to any particular form, but may be of various forms. For example, the burner 10 may be a premixed type burner, a diffused-combustion type burner and besides a vaporizing combustion type burner or another type of burners. Among these, the diffused-combustion type burner needs a zone where the burning reaction is started (hereinafter, referred to as "initial burning reaction zone") because fuel and combustion air are mixed downstream of the burner. On the downstream side of the burner 10, along the axis 11, a space in surrounded by the first water tube array 6 and has no water tubes 5 present on its inner circumferential side. This space is ensured as the initial burning reaction zone. Therefore, reduction of $NO_x$ emission can be effectively achieved without impeding the mixing and burning reaction of fuel and combustion-air.

Figure 4:
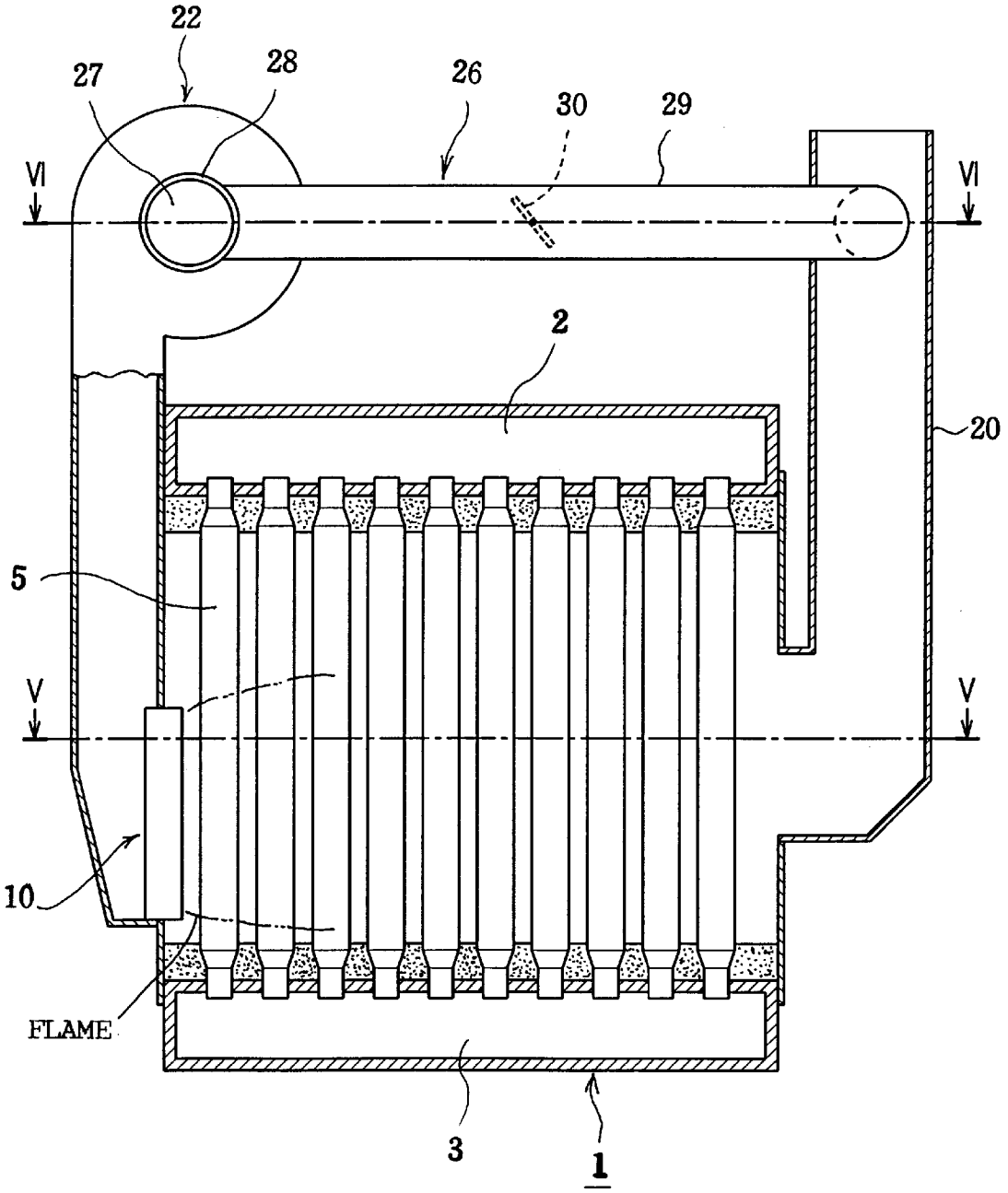
FIG. 4 is an explanatory view of a vertical cross section of a second embodiment of the invention.
Figure 5:
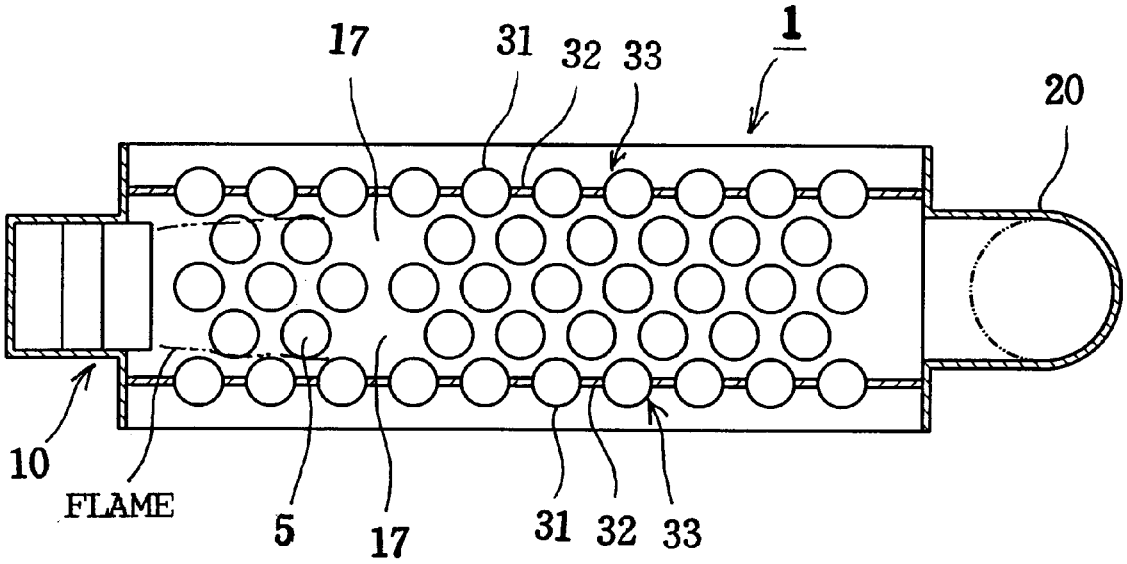
FIG. 5 is an explanatory view of a cross section taken along the line V—V of FIG. 4.
Figure 6:
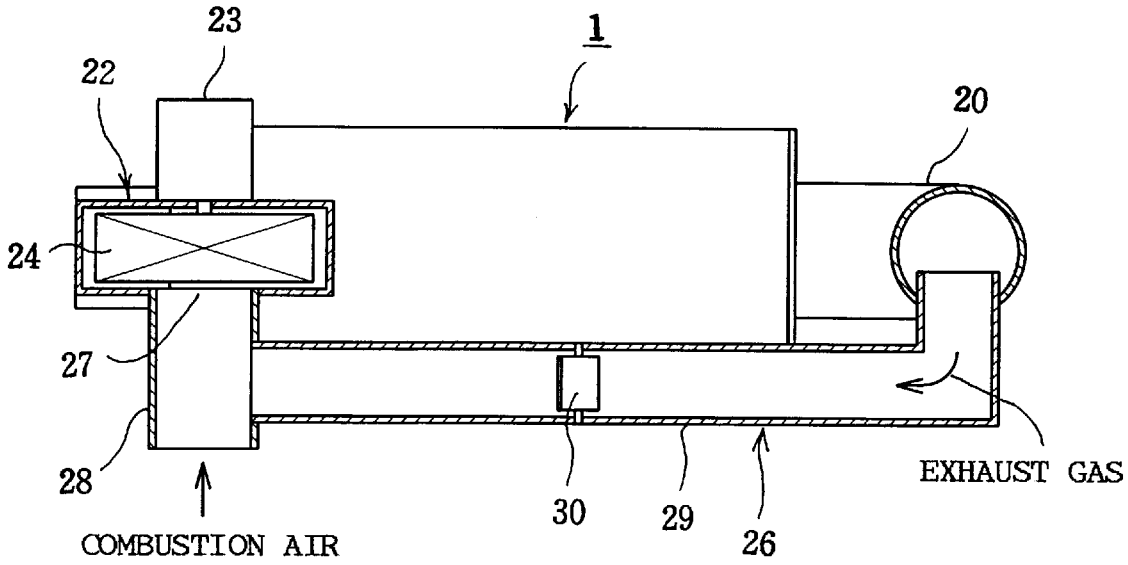
FIG. 6 is an explanatory view of a cross section taken along the line VI—VI of FIG. 4.

In the first embodiment as described hereinabove, a plurality of water tubes 5 are arranged generally along an annulus generally equidistant from each other in the burning reaction zone within the combustion chamber 9. However, present invention is not limited to such an arrangement, and may be arranged as in the second embodiment shown in FIGS. 4 to 6. FIG. 4 is a vertical cross section of the second embodiment of the invention. FIG. 5 is of a cross section taken along the line V—V of FIG. 4, and FIG. 6 is explanatory view of a cross section taken along the line VI—VI of FIG. 4. It is noted that the same component members as in the first embodiment are designated by like reference numerals in the description of the second embodiment, and their detailed description is omitted for brevity.

In the second embodiment shown in FIGS. 4 to 6, a boiler body 1 is provided with rectangular upper header 2 and lower header 3, and has a plurality of water tubes arranged between the upper header 2 and lower header 3. A pair of water walls 33, 33 formed by coupling outer water tubes 31 to one another with coupling members 32 are provided on both sides to form a combustion chamber 9 between these water walls 33, 33. A plurality of water tubes 5 are staggered within this combustion chamber 9.

A burner 10 is provided at one end of the boiler body 1, and a smokestack 20 is provided at the other end thereof. Burning reaction ongoing gas derived from the burner 10 flows through gaps 16 between the water tubes 5 in a direction intersecting the water tubes 5. Along the flow path through which the burning-reaction ongoing gas flows, a burning-reaction continuing zone 17 is provided. The burner 10 is for example a premixed type gas burner having a planar burning surface.

As described hereinabove, according to the present invention, there can be provided a water-tube boiler which can fulfill further reduction in $NO_x$, and which can achieve both $NO_x$ emission reduction and CO emission reduction at the same time, by virtue of devised arrangement of water tubes, so that the water-tube boiler produces clean exhaust gas to meet environmental problems.

What is claimed is:

1. A water-tube boiler comprising:

a burner;

a plurality of first water tubes arranged in a combustion chamber so as to be exposed to a burning-reaction ongoing gas from said burner, said first water tubes being spaced apart from one another at a plurality of locations;

an exhaust gas recirculation system constructed and arranged to recirculate a portion of a combustion exhaust gas back to said burner; and a plurality of second water tubes arranged along an annulus so as to form a second water tube array, said second water tube array being radially outward of said first water tube array with a burning-reaction continuing zone therebetween.

2. The boiler according to claim 1, wherein said plurality of first water tubes are arranged along an annulus so as to form a first water tube array, said burner being arranged within a region defined by said plurality of first water tubes.

3. The boiler according to claim 1, wherein said exhaust gas recirculation system comprises:

a smokestack for carrying the exhaust gas out of the boiler;

an exhaust pipe communicating said smokestack with said burner;

a control damper constructed and arranged in said exhaust pipe to control an amount of the exhaust gas drawn in from said smokestack and fed to said burner.

4. The boiler according to claim 1, wherein said second water tubes are spaced apart from each other at a plurality of locations.

5. The boiler according to claim 1, wherein each said second water tube includes a heat transfer fin mounted thereon.

6. The boiler according to claim 1, wherein said burner points in a direction transverse to said plurality of water tubes.

7. A boiler comprising:

a burner;

a first header;

a second header spaced from said first header;

a plurality of first water tubes extending between and in communication with said first and second headers, said first water tubes being spaced apart from one another at a plurality of locations such that a burning-reaction ongoing gas produced by said burner can pass therebetween; and an exhaust gas recirculation system constructed and arranged a part of an exhaust gas exhausted from the boiler back to said burner.

8. The boiler according to claim 7, wherein said first water tubes are arranged along an annulus, said burner pointing into a region defined by said annulus.

9. The boiler according to claim 8, further comprising a plurality of second water tubes arranged along an annulus radially outward from said plurality of first water tubes.

10. The boiler according to claim 9, wherein said second water tubes are spaced apart from one another at a plurality of locations.

11. The boiler according to claim 1, wherein said second water tubes each include a heat transfer fin.

12. The boiler according to claim 7, wherein said burner is arranged so as to point transverse to said plurality of first water tubes.

13. The boiler according to claim 7, wherein said exhaust gas recirculation system includes ductwork constructed and arranged to convey exhaust gas to said burner, and a control damper constructed and arranged to control how much of the exhaust gas is directed to said burner.

* * * * *